United States Patent [19]

Dubuit et al.

[11] 4,122,768

[45] Oct. 31, 1978

[54] SCREEN PRINTING PRESS ATTACHMENT FOR PRINTING OBJECTS OF REVOLUTION

[75] Inventors: Jean-Louis Dubuit, Paris, France; Charles H. Derrickson, Chicago, Ill.

[73] Assignee: Dubuit of America, Inc., Chicago, Ill.

[21] Appl. No.: 788,911

[22] Filed: Apr. 19, 1977

[51] Int. Cl.[2] ..... B41F 17/22

[52] U.S. Cl. ..... 101/39; 101/126

[58] Field of Search ..... 37/38 R, 38 A, 39, 40, 37/35, 112, 114, 115, 123, 124, 126

[56] References Cited

U.S. PATENT DOCUMENTS

| | | | |
|---|---|---|---|
| 3,090,300 | 5/1963 | Dubuit | 101/123 |
| 3,180,252 | 4/1965 | Fuerst | 101/40 |
| 3,190,463 | 6/1965 | Cohan | 101/38 R X |
| 3,249,043 | 5/1966 | Karlyn et al. | 101/38 R |
| 3,810,422 | 5/1974 | Kammann | 101/40 |

FOREIGN PATENT DOCUMENTS

| | | | |
|---|---|---|---|
| 2,060,731 | 6/1972 | Fed. Rep. of Germany | 101/123 |

*Primary Examiner*—Clifford D. Crowder

*Attorney, Agent, or Firm*—McDougall, Hersh & Scott

[57] ABSTRACT

An improved apparatus for automatically printing two faces of an object. The present invention is an attachment for use with a screen printing press of the type shown in U.S. Pat. No. 3,090,300, issued to Louis Gilbert Dubuit on May 21, 1963. The attachment permits the utilization of two separate sections of the same screen to print the face and reverse side of an object of revolution, such as a bottle, and particularly bottles of oval or irregular shape. The attachment consists of a main drive train which rotates the bottle at the same surface speed as the movement of the screen. Means are provided to flip or invert the bottle 180° during the return stroke with a separate means provided to shift the screen relative to the drive, presenting a different section of the screen to the reverse side of the bottle for printing when the machine cycles through its normal print stroke. As is customary in printing irregular objects, the squeegee is held stationary and the screen and object move at the same speed beneath the squeegee to print the impression in the screen on the work.

6 Claims, 4 Drawing Figures

SCREEN PRINTING PRESS ATTACHMENT FOR PRINTING OBJECTS OF REVOLUTION

This invention relates to improvements for printing on objects of revolution, such as round and oval bottles, or containers or other surfaces of irregular shape with such printing being accomplished through screen printing or the like. For ease of reference, it will be described in reference to a bottle, however, it is to be understood that any curved or irregular object is intended.

The technique of screen printing, which is sometimes referred to as silk screen printing, is well known. The process dates back to ancient times and consists of forcing ink through a screen mesh of silk or other suitable material. Some of the mesh is open, which represent the design to be printed, and this permits the ink to pass through the mesh onto the object.

In the present invention, a bottle is held in position in an air-operated chuck or the like. As the screen moves down onto the work, a bottle moves into the print position with the long axis pointing angularly upward quite close to the squeegee. The screen and portion of the bottle to be printed contact the squeegee and the bottle moves along a radius with the screen moving linearly. When the bottle completes its passage beneath the squeegee, the screen and squeegee lift and the bottle reverses, with a novel means provided to flip the bottle 180° while it is traveling in a reverse direction. In this manner, the reverse side of the bottle is presented to be printed on the second stroke of the machine. Also, during the return stroke the screen is shifted relative to the drive arm by an air cylinder or other suitable means so that the other half of the screen not utilized in the printing of the face of the bottle may be utilized in printing the reverse side of the bottle which is presented on the return stroke. The present invention provides the advantage of reducing the number of times a bottle must be handled, i.e., it can be printed on both sides in the same machine and assures accurate registration.

It is, therefore, an object of this invention to provide a new and improved workholder for printing two sides of a bottle or other article of revolution.

It is a further object of this invention to provide a new and improved attachment which permits convenient and easy adjustment of registration in printing of an object of revolution, such as a bottle of oval or irregular shape.

It is a further object of this invention to provide a new and improved attachment in which two sides of an article of revolution may be printed on the same screen while being held in the same workholder while providing excellent registration.

Other objects and advantages of the invention will be brought out in the description which follows below, given by way of example with reference to the accompanying diagrammatic drawings, in which.

Figure 1:
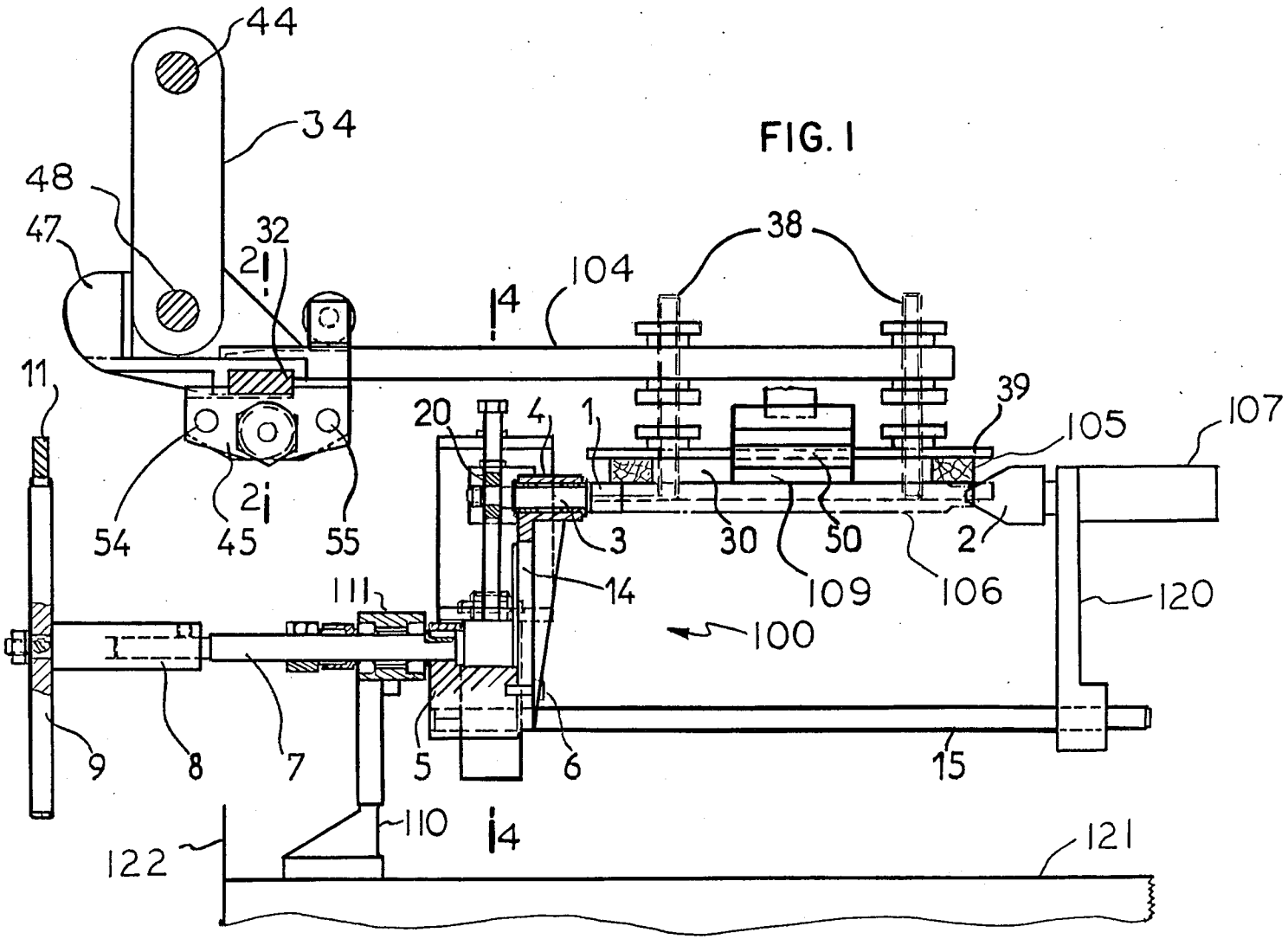
FIG. 1 is a side elevational view of the workholder of the present invention with a fragmentary portion of a screen printing machine illustrated at the left-hand side of FIG. 1.
Figure 2:
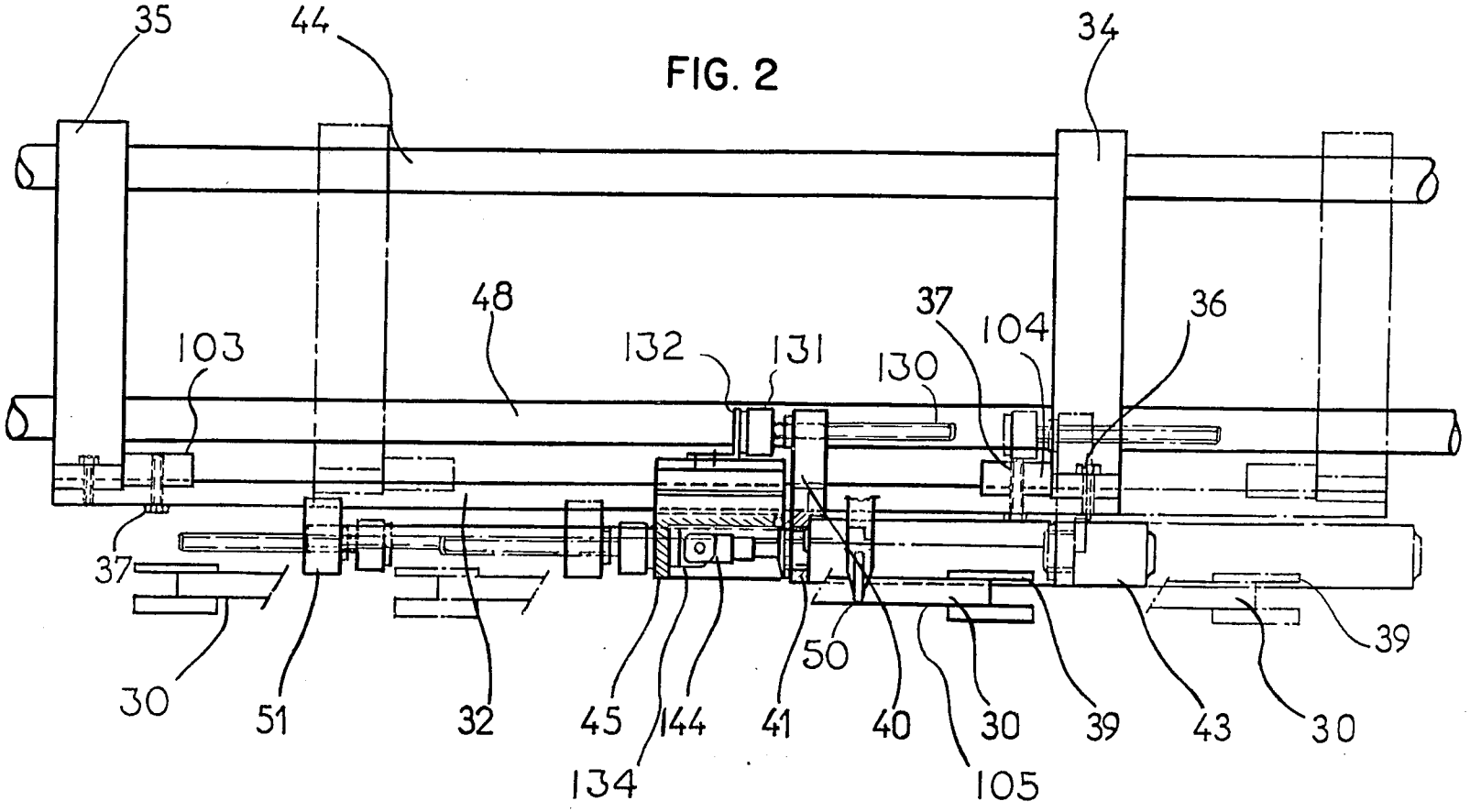
FIG. 2 is taken along the line 2—2 of FIG. 1 and illustrates in dashed lines the position the screen occupies when printing the reverse side of the bottle.

Referring now to FIG. 1, reference numeral 100 generally refers to the workholder of the present invention. At the left-hand portion of FIG. 1 are shown in cross section shafts 44 and 48, which are the front shafts of a screen printing machine of the type shown in U.S. Pat. No. 3,090,300, issued to Louis Gilbert Dubuit on May 21, 1963. The shafts 44 and 48 support a pair of screen support arms 34 and 35 (only support arm 34 shown in FIG. 1). As seen in FIG. 2, the lower ends of the arms 34 and 35 are joined together by a screen support bar 32 which supports the screen support arms 103 and 104. Arms 103 and 104 are joined by screen support bar 32 and support a screen in a conventional manner by means of a bracket 39 which by means of threaded elements 38 clamps the frame 105 of the screen 30 into position. As customary, the screen 30 is attached to the lower part of the frame 105 and a squeegee 50 is supported over the screen and remains in contact with the screen during the printing stroke. In accordance with the operation of the screen press described in U.S. Pat. No. 3,090,300, the squeegee 50 elevates faster than the screen 30 when the screen 30 is lifted off the work, but remains in contact with the screen 30 when the screen 30 is lowered onto the work for printing. For ease of description, the squeegee is shown schematically without the attachment to the squeegee support arm, all of which are illustrated in U.S. Pat. No. 3,090,300 and incorporated herein by reference.

A workholder 100 is shown having jaws 1 and 2 which grip an object of revolution 106, which may be a bottle or other type of object. For purposes of the present invention, the bottle 106 will be described as being an oval bottle, however, the principles of the present invention may be utilized in connection with any object of revolution in which it is desired to print on opposite sides.

Figure 3:
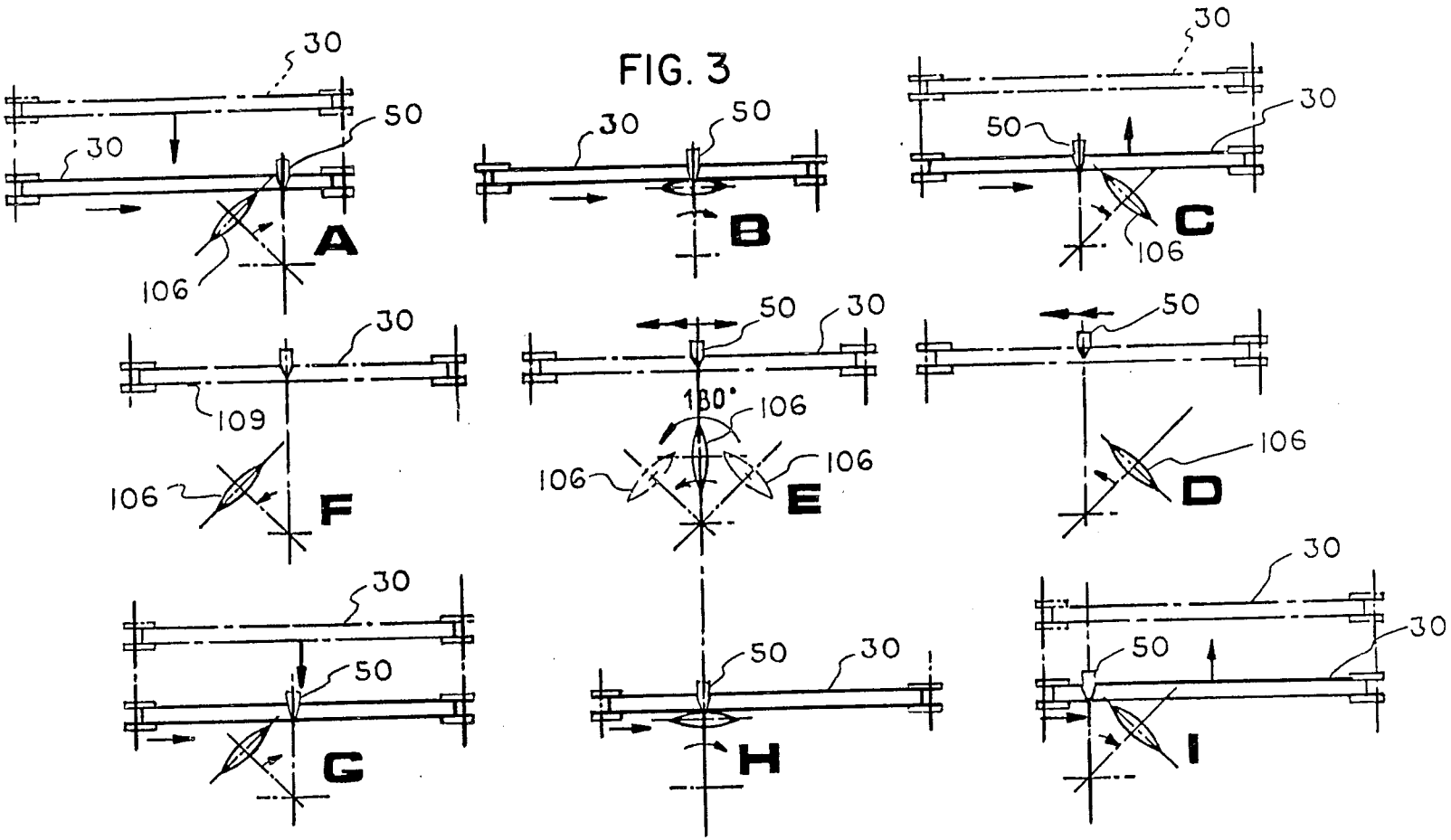
FIGS. 3A–3I are schematic free-body diagrams showing the screen and bottle as it goes through the printing cycle.

The invention utilizes the right-hand portion of the screen 30 (FIGS. 2 and 3) to print the face of the bottle, and at the end of the print stroke, while the screen is lifted and returned to the initiation of the stroke, the bottle is returned and flipped or inverted to present the reverse side of the oval. During this time, the screen 30 is shifted to the right so that the left-hand portion is over the bottle 106. The print stroke is again initiated to print the reverse side of the bottle.

As pointed out above, the jaws 1 and 2 hold the bottle 106, with the jaw 2 being linearly movable inwardly and outwardly by an air cylinder 107 to press the bottle 106 against the jaw 1. For clarity, the jaw 1 is only shown in dotted lines in FIG. 4.

In order to print on solid objects, such as the bottle 106, it is essential that it move at the same speed as the screen 30 and remain in uniform contact with the screen 30 beneath the squeegee. To the attainment of this end, a rack 11 is shown at the left-hand portion which drives the pinion 9 which, in turn, is keyed or otherwise joined to the shaft 7 through a collar 8.

A mounting bracket 110 rests on a tooling bar 121 and supports a bearing 111 which supports the shaft 7 for rotation. The opposite end of the shaft 7 is joined to a mounting block 5, which rotates with the shaft 7. A suitable fastener, such as a bolt 6, joins a second mounting bracket 4 through an adjusting slot 14 to the mounting block 5. A bearing is provided at the upper end of the mounting bracket 4 to support a shaft 3, which is joined to the base of the jaw 1 of the workholder.

In practice, the chuck 1 is shaped to fit the bottom of the container or object to be printed. In the present case, the jaw or chuck 1 is oval, whereas the opposing jaw or chuck 2 is frusto-conical to fit within the mouth of the bottle and force it against the chuck 1 when the air cylinder 107 is actuated. The other end of the shaft 3 is joined to a pinion gear 20, shown in dotted lines in FIG. 4.

Figure 4:
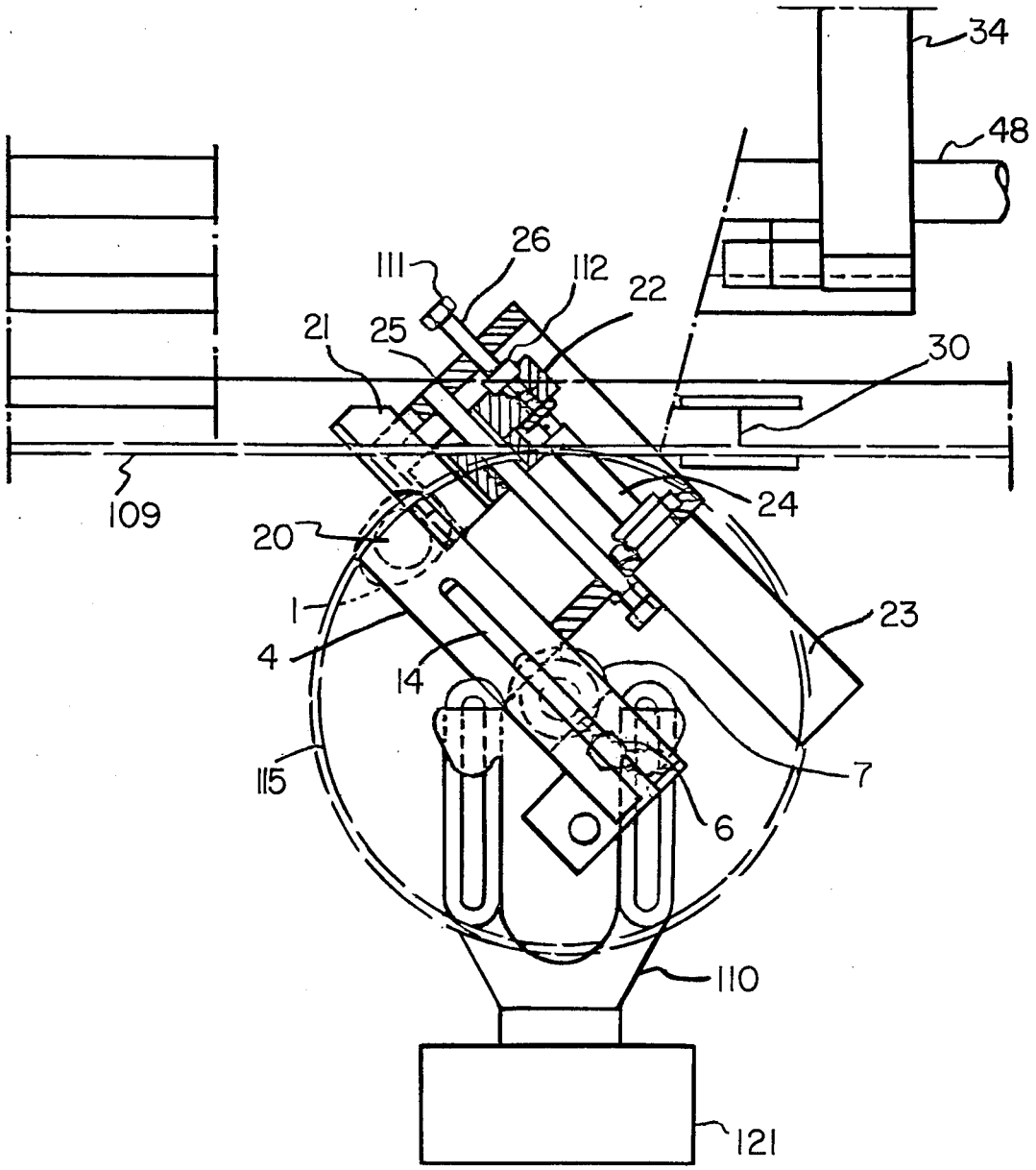
FIG. 4 is a cross-sectional view taken generally along the line 4—4 of FIG. 1 and illustrating the mechanism for turning the bottle 180° to expose the reverse side for printing.

As best seen in FIG. 4, a rack 21 is mounted on the lower end of a carriage 22 with the upper end of the carriage 22 attached to the rod 24 of an air cylinder or the like 23. The outer end of the rod 24 is threaded as at 26 and provides adjusting nuts 111 and 112 for purposes to become apparent. A guide rod 25 is also provided to guide carriage 22 in its reciprocating movement. The rack 21 engages the pinion 20 for purposes to become apparent.

As seen in FIG. 4, the axis of the shaft 7 is located directly beneath a point where the outer circle or circle of revolution 115 of the object 106 contacts the underside of the screen 30. The slot 14 is provided with a bolt 6 which permits inward and outward adjustment of the chuck 1 to accommodate any diameter of bottle. The pinion gear 20 is on the same axis of rotation as the chuck 1 and is supported by the mounting bracket 4.

Also mounted on the casting or mounting block 5 is a rod 15 which supports a mounting bracket 120. An air cylinder 107 and chuck 2 are carried on the bracket 120 so that the entire mechanism may be rotated together.

Referring now to FIGS. 3A–3I, a schematic diagram illustrating the function of the apparatus of the present invention is illustrated. At the initial part of the print stroke, the screen 30 is positioned with the right-hand portion of the screen directly beneath the squeegee 50. As illustrated in dotted lines, the screen 30 has moved from the position immediately above the work 106 down into the print position. The bottle 106 is rotated in the workholder 100 in a clockwise direction as the screen 30 moves to the right in the direction of the arrow. As the bottle 106 and screen 30 meet beneath the squeegee 50, the impression in the screen 30 is squeegeed onto the bottle 106, as shown in FIG. 3B. The screen 30 continues to move to the right and the bottle 106 moves angularly clockwise, ultimately moving away from the screen 30, at which time the screen 30 and squeegee 50 are elevated to the position shown in dotted lines in FIG. 3C.

As they are elevated, the screen 30 and squeegee 50 begin to move to the left, as shown by the arrows, with such movement causing the rack 11 to drive the pinion 9 in the opposite direction. This causes the bottle 106 to move angularly in a counterclockwise direction. As this time, a microswitch is energized, causing the mechanism shown in FIGS. 1 and 4 to move the bottle through a 180° counterclockwise movement relative to the angularly-moving mounting block 4 which continues in a counterclockwise direction, being rotated by the shaft 7.

As observed in the dotted line version of FIG. 3E, the bottle is inverted or flipped 180° and at the end of the return stroke, occupies the position shown in FIG. 3F. During the inversion of the bottle, as shown in FIG. 3E, the screen 30 moves to the right by the mechanism which is shown in front elevational view in FIG. 2 and side elevation in FIG. 1. This will be more specifically described hereinafter with reference to these figures.

After the screen 30 is shifted, the squeegee 50 is positioned over the central part of the screen 30 as seen in FIG. 3F to print the reverse side of the bottle 106. As the printing machine goes through a second print cycle, the reverse side of the bottle 106 is printed, as shown in FIGS. 3G, 3H and 3I, in the same manner as shown in FIGS. 3A, 3B and 3C. The air cylinder 107 is then deenergized to withdraw chuck 2 from the bottle, thereby permitting the operator to remove the bottle from the chuck 1 for flame-treating, drying and/or packaging for shipping.

The mechanism for shifting the screen 30 is best shown in FIG. 2. Portions of the front shafts 44 and 48 of the screen printing machine are shown in generally full elevation and support the screen support arms 34 and 35. Attached to the base of the screen support arms is a screen support bar 32 which joins the two arms in spaced relationship. As pointed out in the patent to Louis Gilbert Dubuit, U.S. Pat. No. 3,090,300, the screen support arms 34 and 35 are free to reciprocate along the shafts 44 and 48 when the machine is in the mode to print solid objects rather than flat printing. The screen 30 is driven or reciprocated off the main screen drive through a block 45. During the print cycle, the drive block 45 reciprocates linearly along the path parallel to the axis of the shafts 44 and 48, moving the screen 30. In the normal set up, the block 45 is attached directly to the screen support bar 32 to shift the screen 30 in timed relation with the press drive mechanism (not shown). The present invention has the screen 30 connected to the drive block 45 through a pair of blocks 51 and 41, which are mounted on the screen support bar 32. A guide block 40 is also mounted on the screen bar 32 and has a guide rod 130 joined to the drive block 45 at 131 by means of a bracket 132. An air cyclinder 43 is mounted by means of a fastener 36 on the lower end of the arm 34 with the piston rod of the air cylinder joined to a bracket 134 by a clevis or equivalent. The bracket 134 is attached to the block 45 and moves with it.

In operation, as the screen is returning for the second print stroke, as exemplified in FIGS. 3D, 3E and 3F, the air cylinder 43 is operated to retract the piston rod end 144. Inasmuch as the end of the rod 144 is attached to the drive block 45, the entire screen arms 34 and 35 move to the right along the shafts 44 and 48 to the position shown in dotted lines, even though the rods 44 and 48 are moving to the left. The screen 30 is also shown in dashed lines to illustrate that the squeegee 50, on actuation of the cylinder, is now positioned at the midpoint of the screen, as shown in FIGS. 3F and 3G, rather than the far right, as shown in FIG. 3A. The cylinder 43 remains energized throughout the print cycle of the reverse side of the bottle, thereby presenting the left-hand side of the screen to the face of the bottle, as shown in FIGS. 3G, 3H and 3I.

It should be appreciated that adjustable stops are provided on the mounting block 131 so that the travel of the cylinder is limited in each instance. Thus, any error in cylinder travel may be readily compensated for to provide accurate registration. In a similar manner, adjustments are provided on the shaft 26 of the cylinder 23, shown in FIG. 4, to provide for precise registration when the bottle is inverted or flipped on the return stroke. This provides a positive control for the cylinder to assure accurate registration in all respects.

It can be seen from the foregoing that the present invention provides an attachment which permits printing on opposite sides of an irregular or symmetrically shaped object. The attachment is particularly useful in printing oval bottles which are quite popular in the marketing of soaps, cosmetics and the like.

Upon a consideration of the foregoing, it will become obvious to those skilled in the art that various modifications may be made without departing from the invention embodied herein. Therefore, only such limitations should be imposed as are indicated by the spirit and scope of the appended claims.

We claim:

1. An attachment for use with a screen printing machine to permit printing upon both sides of an object with a stencil screen, said screen printing machine having means mounting said stencil screen, and drive means to move said means mounting said stencil screen horizontally for printing a first side of said object, to then return said means mounting said stencil screen, and to then again move said means mounting said stencil screen horizontally for printing a second side of said object, and squeegee means in engagement with said screen to force ink onto said object, said attachment including workholder means for rotating said object to be printed in timed relationship with horizontal movement of said screen, said squeegee means being in an operative position over said screen to print said object while said screen is moving horizontally from a first position to a second position to print on said first side of said object, means carried on said means mounting said stencil screen to shift said screen from said second operative position to a third operative position while said drive means returns said means mounting said screen, inverter means on said workholder means to rotate said object to be printed to expose said second side of said object while said workholder is moving said object to a location beneath said screen in said third operative position whereby said second side of said object may be printed with said same screen as it is moved to a fourth position.

2. The attachment for screen printing machines as defined in claim 1 wherein said means to shift said screen to a third operative position includes an air cylinder carried on said means mounting said stencil screen, actuation of said cylinder moving said stencil screen relative to said means for driving said stencil screen.

3. The attachment for screen printing means as defined in claim 1 including a first shaft supporting said workholder means, a pinion tied to said first shaft, and a rack for driving said pinion, said rack thereby driving said workholder means in timed relationship with said horizontal movement of said screen, said inverter means including an assembly mounted on said workholder means, said assembly comprising a rotatable chuck, and assembly drive means for rotating the chuck.

4. An attachment for screen printing machines as defined in claim 3 wherein said assembly drive means comprises a pinion and a second shaft supporting the pinion, said chuck being operatively connected to said second shaft, and a rack associated with said last mentioned pinion for rotating said second shaft and said chuck relative to said first shaft.

5. An attachment for screen printing machines as defined in claim 4 wherein said assembly drive means includes an intermittent operating pressure drive means connected to said rack for rotating said second shaft relative to said first shaft.

6. The attachment for screen printing machines as defined in claim 4 wherein said first shaft and said second shaft are maintained in a constantly spaced, parallel relationship throughout the printing cycle.

* * * * *